US005774103A

United States Patent [19]

Choi et al.

[11] Patent Number: 5,774,103

[45] Date of Patent: Jun. 30, 1998

[54] METHOD FOR DRIVING A LIQUID CRYSTAL DISPLAY

[75] Inventors: Sun-jung Choi; Cheol-woo Park, both of Suwon; Choon-yul Oh, Anyang, all of Rep. of Korea

[73] Assignee: Samsung Display Devices Co., Ltd., Kyungki-do, Rep. of Korea

[21] Appl. No.: 552,367

[22] Filed: Nov. 2, 1995

[30] Foreign Application Priority Data

Sep. 5, 1995 [KR] Rep. of Korea ..... 95-28953

[51] Int. Cl.[6] ..... G09G 3/20; G09G 3/36

[52] U.S. Cl. ..... 345/94; 345/58; 345/95; 345/96

[58] Field of Search ..... 345/87, 94, 95, 345/96, 97, 98, 99, 208, 209, 58

[56] References Cited

U.S. PATENT DOCUMENTS

| | | | |
|---|---|---|---|
| 4,724,433 | 2/1988 | Inoue et al. | 345/208 |
| 5,089,812 | 2/1992 | Fuse et al. . | |
| 5,267,065 | 11/1993 | Taniguchi et al. | 345/97 |
| 5,283,564 | 2/1994 | Katakura et al. | 345/94 |
| 5,321,419 | 6/1994 | Katakura et al. | 345/95 |
| 5,353,041 | 10/1994 | Miyamoto et al. | 345/97 |
| 5,489,919 | 2/1996 | Kuwata et al. | 345/100 |
| 5,583,534 | 12/1996 | Katakura et al. | 345/97 |
| 5,594,466 | 1/1997 | Yamamoto et al. | 345/94 |
| 5,606,343 | 2/1997 | Tsuboyama et al. | 345/97 |
| 5,608,420 | 3/1997 | Okada | 345/94 |
| 5,610,628 | 3/1997 | Yamamoto et al. | 345/94 |
| 5,638,088 | 6/1997 | Mano et al. | 345/95 |

FOREIGN PATENT DOCUMENTS 598913 10/1993 European Pat. Off. .

OTHER PUBLICATIONS

J. Nehring et al.; "Ultimate Limits for Matrix Addressing of RMS–Responding Liquid–Crystal Displays"; IEEE Transactions on Electron Devices, vol. 26, No. 5, May 1979, New York.

*Primary Examiner*—Steven Saras
*Assistant Examiner*—David L. Lewis
*Attorney, Agent, or Firm*—Leydig, Voit & Mayer, Ltd.

[57] ABSTRACT

In a method for driving a matrix liquid crystal display (LCD), whereby the selection ratio of a scanning electrode is improved and the voltage magnitude variation is considerably reduced, the scanning electrode driving signals are made to overlap each other according to an orthogonal function to then be sequentially applied to adjacent scanning electrodes. The data electrode driving signals are made to change in their voltage level through the step of maintaining an intermediate voltage level in the overlap interval to then be applied to data electrodes in the alternative, or the scanning electrode driving signals having opposite polarity are periodically applied to adjacent scanning electrodes. Therefore, the selection ratio of scanning electrodes are improved and the generation of the waveform differential is minimized, thereby reducing the crosstalk generated in a picture.

10 Claims, 3 Drawing Sheets

$$G_1(t) = -cF_1(t) + cF_2(t) - cF_3(t) + cF_4(t) + cF_5(t)$$

FIG. 3A
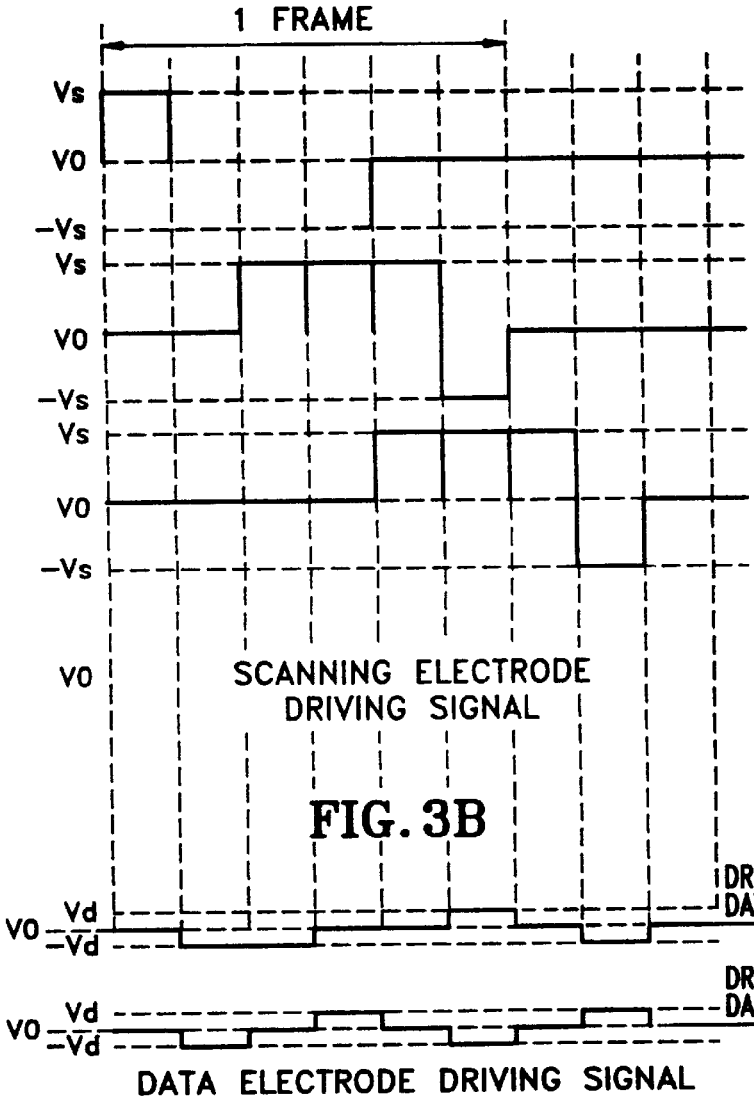
FIG. 3B
FIG. 3C
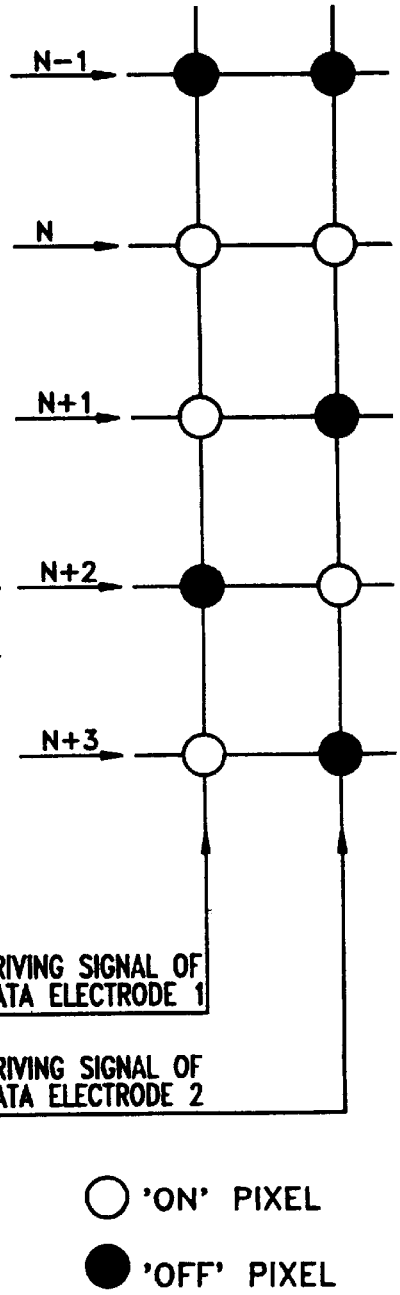

METHOD FOR DRIVING A LIQUID CRYSTAL DISPLAY

BACKGROUND OF THE INVENTION

The present invention relates to a method for driving a matrix liquid crystal display (LCD), whereby the selection ratio of a scanning electrode is improved and the voltage magnitude variation is considerably reduced.

A matrix liquid crystal display device is largely composed of the scanning electrodes which control the scanning lines of the display device and controlling the data electrodes which are displayed on each pixel, when the respective scanning lines are selected. A voltage averaging method adopting a line sequential driving method using multiplexing, is standardized as the simple matrix LCD driving method. However, this method is used without losing the contrast of picture, only when the liquid crystal response is slow, that is, when the response time of the LCD is about 400 msec. Therefore, in the fields demanding a high-speed response characteristic, i.e., when a quick response to the transfer speed of a computer mouse or to a moving picture display speed is necessary, a multi-line scanning (MLS) method or an active addressing (AA) method has been used.

First, according to the line sequential driving method, scanning electrodes are driven by sequentially applying a selection pulse to each line. FIGS. 1A through 1D are waveform diagrams of scanning electrode and data electrode driving signals, and signals applied to the pixels according to the scanning and data electrode driving signals, when a simple matrix LCD composed of 2×6 pixels is driven by the voltage averaging method using the line sequential driving method. According to the line sequential driving method, pulses (scanning electrode driving signals) of a voltage Vs are sequentially applied to scanning electrodes 1, 2, 3, 4, 5 and 6, as shown in FIG. 1A, and pulses (data electrode driving signals) of voltages +Vd and −Vd are applied to data electrodes 1 and 2. Therefore, as shown in FIG. 1D, LCD is driven by the pixel signals (voltages Vd, 2Vd, 3Vd and −Vd) shown in FIG. 1C, which are formed by averaging voltages Vs and Vd. At this time, the selection ratio of the respective scanning electrodes are determined by a driving duty ratio of the display device. Thus, if the response of the LCD becomes fast, the contrast of picture is reduced by a frame response. Therefore, this method is practically difficult to adopt for an instrument necessitating a quick transfer speed of picture, such as a mouse for a computer.

Also, since the voltage of the data electrode driving signal applied to the data electrode is large itself, the voltage switching range is extremely wide, which produces differential waveform to a non-selected scanning electrode and causes crosstalk in a picture.

Next, as shown in FIG. 2, according to the MLS method or AA method, plural scanning electrodes are simultaneously selected to then be sequentially driven thereafter. FIG. 2 shows signals applied to scanning electrodes and data electrodes when LCD is driven by adopting the AA method. As shown in FIG. 2, according to the AA method, a plurality of scanning electrodes $F_1$ to $F_5$ are simultaneously selected at a time t to be driven thereafter. At this time t, the data electrode driving signal $G_1(t)$ which equals to $-cF_1(t)+cF_2(t)-cF_3(t)+cF_4(t)+cF_5(t)$ is applied to the data electrode $G_1$ and then two pixels become "on."

This method has an advantage in that it can be adopted for a high-speed responsive LCD due to the increased duty ratio of the LCD, by simultaneously driving a plurality of electrodes. However, this method requires many data voltage levels. Also, it requires an additional storage device and an operating circuit for a screen data, which increases the cost for the driving apparatus.

SUMMARY OF THE INVENTION

To solve the above problem, it is an object of the present invention to provide a method for driving a matrix LCD, whereby the selection ratio of a scanning electrode is improved, and crosstalk displayed on a screen is reduced by reducing the voltage of the waveform differential produced to a non-selected scanning electrode in changing the voltage of a data electrode driving signal.

To accomplish the above object, there is provided a matrix LCD driving method according to the present invention, comprising the steps of: driving scanning electrodes by sequentially applying to the scanning electrodes an orthogonal function scanning electrode driving signal composed by a combination of a selection pulse and a compensation pulse, whose pulse width is narrower than that of the selection pulse by a predetermined width, and which also has an opposite polarity so that the selection pulses of the scanning electrode driving signals applied to adjacent scanning electrodes overlap each other by a predetermined interval; and driving data electrodes by applying the data electrode driving signals composed of pulses having the same voltage level and the opposite polarity to each other, to the data electrodes of an LCD panel wherein the data electrode driving signals are applied to each selection pulse interval of the scanning electrode driving signals applied to adjacent scanning electrodes by maintaining a predetermined intermediate voltage level within an overlap interval, so that the voltage level change in the pulse of the data electrode driving signals occurs via the predetermined intermediate voltage level in the overlap interval.

In the present invention, based on the voltage level for non-selection of the scanning electrode driving signal, the absolute value of the voltage level of the selection pulse is preferably the same as that of the voltage level of the compensation pulse, in the scanning electrode driving step The predetermined intermediate voltage level of the data electrode driving signal in the data electrode driving step is the same as that of the voltage for non-selection of the scanning electrode driving signal.

In the data electrode driving step, based on the voltage level for non-selection of the scanning electrode driving signal, the absolute value of the voltage level of the data electrode driving signal pulse is preferably smaller by a predetermined level than that of the voltage level of the selection or compensation pulse of the scanning electrode driving signal.

In the scanning electrode driving step, the scanning electrode driving signal is preferably in a combination of the sequence going from the selection pulse to the compensation pulse or vice versa.

In the scanning electrode driving step, the scanning electrode driving signal is preferably in a combination of the sequence going from the compensation pulse, to the selection pulse and to the compensation pulse.

In the scanning electrode driving step, the scanning electrode driving signal is preferably overlapped by a half cycle of the overall period of the signals having the selection pulse and the compensation pulse.

In the scanning electrode driving step, the scanning electrode driving signal is preferably changed in its polarity in the unit of a half of the overall signal period or in a predetermined ratio for an alternate driving.

In the scanning electrode driving step, a scanning electrode driving signal having the opposite polarities of those of the selection pulse and the compensation pulse of the scanning electrode driving signal and also having the combination of the selection pulse and the compensation pulse is applied to the scanning electrodes periodically with a predetermined sequence in order to maintain the balance of the voltage change.

BRIEF DESCRIPTION OF THE DRAWINGS

The above objects and advantages of the present invention will become more apparent by describing in detail a preferred embodiment thereof with reference to the attached drawings in which:

FIGS. 3A and 3B are diagrams of scanning electrode and data electrode driving signals for driving scanning electrodes by an orthogonal function signal according to the present invention.

FIG. 3C is a liquid crystal display driven by signals of FIGS. 3A and 3B.

DETAILED DESCRIPTION OF THE INVENTION

Figure 1A:
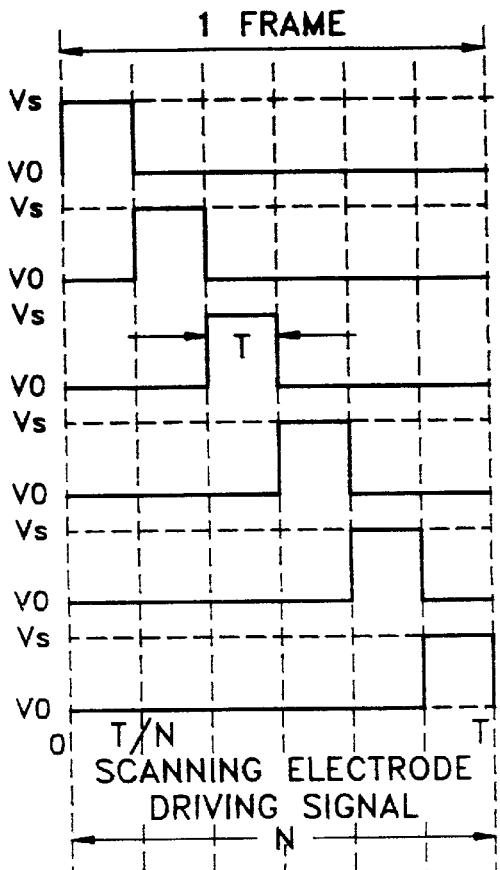
FIG. 1A (PRIOR ART)
FIGS. 1A–1C are diagrams of scanning electrode and data electrode driving signals according to a line sequential driving method.
Figure 1B:
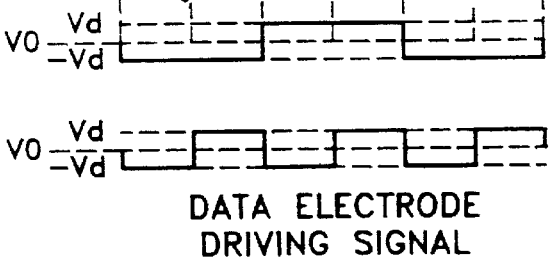
FIG. 1B (PRIOR ART)
Figure 1D:
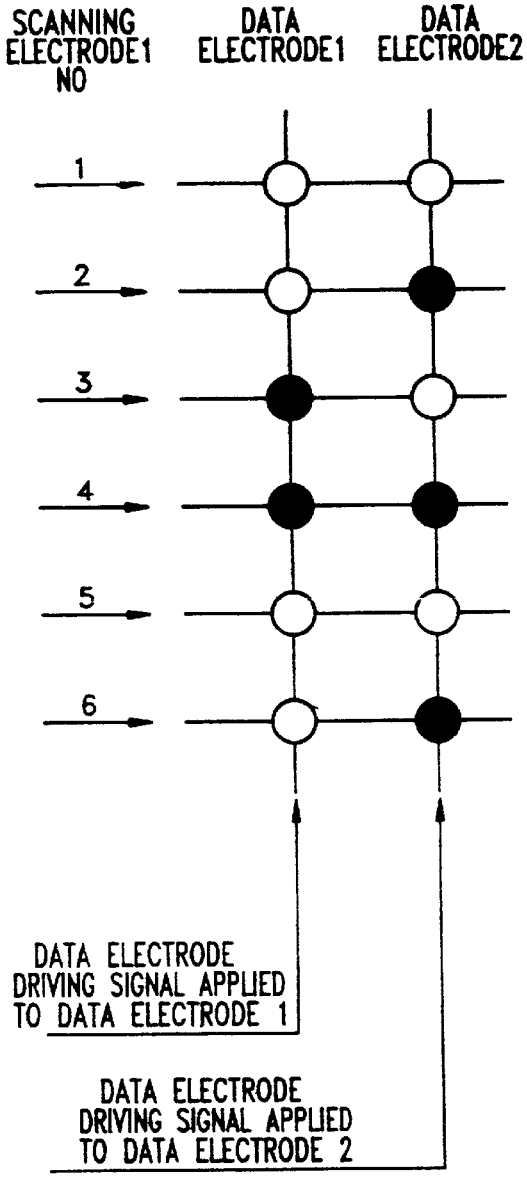
FIG. 1D (PRIOR ART)
FIG. 1D shows a liquid crystal display driven by signals of FIGS. 1A–1C.
Figure 1C:
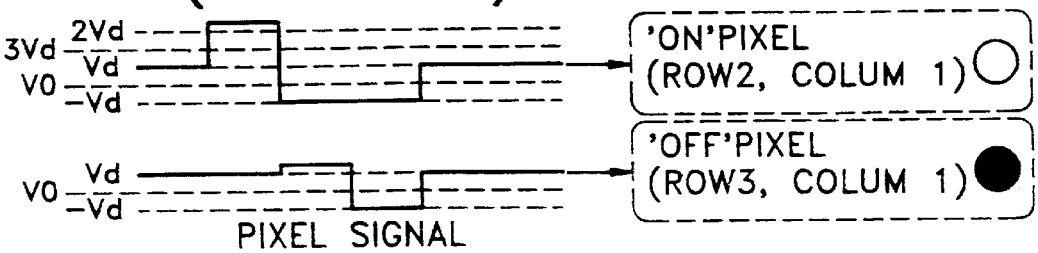
FIG. 1C (PRIOR ART)
Figure 2:
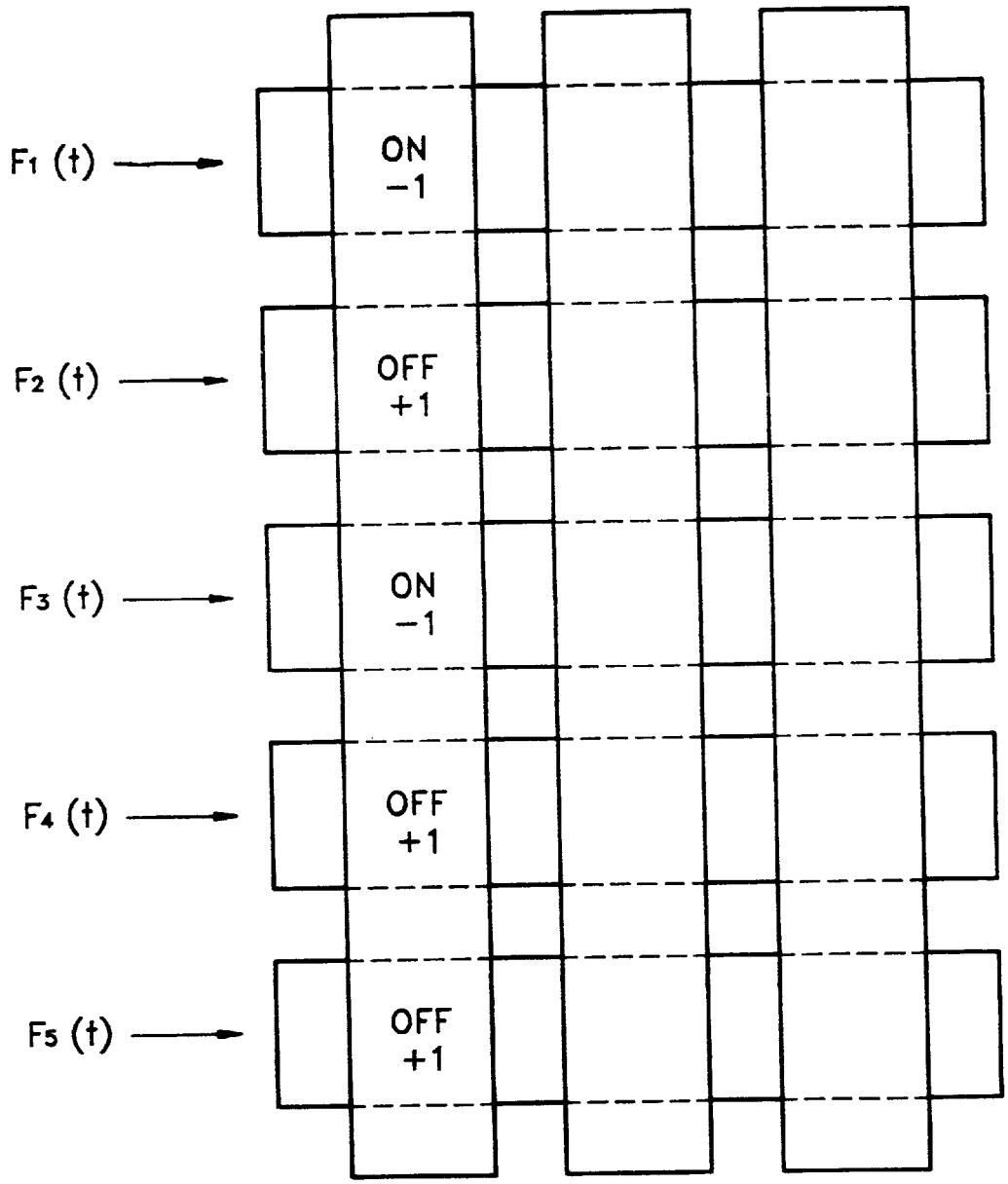
FIG. 2 (PRIOR ART)
FIG. 2 shows scanning electrode and data electrode driving methods according to a conventional active addressing method.

In FIG. 3A, a scanning electrode driving signal composed of three +Vs pulse voltages and one −Vs pulse voltage is overlapped by a half cycle of the overall selection period, i.e., by one line time, in two scanning electrodes (each two among scanning electrodes N−1, N, N+1, N+2 and N+3 in FIG. 3C), e.g., in the sequence of (1,2), (2,3), (3,4), . . . . Therefore, all scanning electrodes are driven while overlapped with their adjacent electrodes but only one electrode is not driven independently.

As shown in FIG. 3B, with the scanning electrode driving method, the data electrode driving signals are changed in their voltage levels via an intermediate voltage level, which is a reference voltage (VO). Thus, the voltage level of the data electrode driving signal is changed by Vd, not by 2Vd as in the conventional line-sequential driving method. Therefore, the waveform differentials produced to adjacent non-selection scanning electrodes are relatively small, which considerably reduces crosstalk generated in the picture. Also, the polarity of the scanning electrode driving signal may be changed in the unit of line time for an alternate driving. In this case, the data electrode driving signal also experiences a polarity change. Therefore, it is possible to correct the operational frequency of the pixels of an LCD by an alternate driving method.

Another embodiment of the present invention is described in FIG. 3A, in which the scanning electrode driving signals are all high-high-high-low. However, for the purpose of maintaining the balance of the voltage change in order to minimize the influence on generating the waveform differential to the data electrodes, the combination of low-low-low-high signals may be adopted. Although not shown in the drawings, in another embodiment of the present invention, the sequence of the scanning electrode driving signals may be low-high-high-high or high-low-low-low.

As described above, according to the LCD driving method of the present invention, the scanning electrode driving signals are made to be overlapped with each other orthogonal-functionally, to then be sequentially applied to adjacent scanning electrodes, and the data electrode driving signals are made to be changed in their voltage levels through the step of maintaining an intermediate voltage level in the overlap interval, which is then applied to the data electrodes, or else, the scanning electrode driving signals having opposite polarity are periodically applied to adjacent scanning electrodes. Therefore, the selection ratio of the scanning electrodes are improved and the generation of the waveform differential is minimized, thereby reducing the crosstalk generated in a picture.

What is claimed is:

1. A matrix LCD driving method comprising the steps of:

driving a plurality of scanning electrodes by:

sequentially applying an orthogonal function scanning electrode driving signal to each of the scanning electrodes, each orthogonal function scanning electrode driving signal including a combination of a selection pulse and a compensation pulse, the compensation pulse having a width narrower than that of the selection pulse by a predetermined amount, the compensation pulse having an opposite polarity from the selection pulse, and overlapping selection pulses of orthogonal function scanning electrode driving signals applied to adjacent scanning electrodes by an overlap interval; and driving a plurality of data electrodes by:

applying data electrode driving signals to the data electrodes, the data electrode driving signals including pulses having the same voltage level and the opposite polarity to each other wherein the data electrode driving signals are applied to the data electrodes during a selection pulse interval of each of the orthogonal function scanning electrode driving signals applied to adjacent scanning electrodes and, when transitioning the data electrode driving signals from a first voltage level to a second voltage level, maintaining the data electrode driving signals at a third voltage level intermediate the first and second voltage levels during the overlap interval of the orthogonal function scanning electrode driving signals applied to adjacent scanning electrodes.

2. The matrix LCD driving method as claimed in claim 1, wherein in the scanning electrode driving step, based on the voltage level for non-selection of each orthogonal function scanning electrode driving signal, the absolute value of the voltage level of the selection pulse is the same as that of the voltage level of the compensation pulse.

3. The matrix LCD driving method as claimed in claim 1, wherein in the data electrode driving step, the intermediate voltage level of the data electrode driving signal is the same as that of the voltage for non-selection of each orthogonal function scanning electrode driving signal.

4. The matrix LCD driving method as claimed in claim 1, wherein in the data electrode driving step, based on the voltage level for non-selection of each orthogonal function scanning electrode driving signal, the absolute value of the voltage level of the data electrode driving signal pulse is smaller than that of the voltage level of one of the selection and compensation pulses of each orthogonal function scanning electrode driving signal by a first level.

5. The matrix LCD driving method as claimed in claim 1, wherein in the scanning electrode driving step, each orthogonal function scanning electrode driving signal is in a combination of the sequence going from the selection pulse to the compensation pulse.

6. The matrix LCD driving method as claimed in claim 1, wherein in the scanning electrode driving step, each orthogonal function scanning electrode driving signal is in a combination of the sequence going from the compensation pulse to the selection pulse.

7. The matrix LCD driving method as claimed in claim 1, wherein in the scanning electrode driving step, each orthogonal function scanning electrode driving signal is overlapped by a half cycle of the overall period of a signal having the selection pulse and the compensation pulse.

8. The matrix LCD driving method as claimed in claim 1, wherein in the scanning electrode driving step, each orthogonal function scanning electrode driving signal is changed in its polarity in the unit of a half of the overall period of the signal for an alternate driving.

9. The matrix LCD driving method as claimed in claim 1, wherein in the scanning electrode driving step, each orthogonal function scanning electrode driving signal is changed in its polarity in a first ratio for an alternate driving.

10. A matrix LCD driving method as claimed in claim 1, wherein in the scanning electrode driving step, the orthogonal function scanning electrode driving signals having the opposite polarities to those of the selection pulse and the compensation pulse of each of the orthogonal function scanning electrode driving signals are applied to the scanning electrodes periodically, with a first sequence in order to balance a voltage change.

* * * * *